United States Patent [19]

Ruskin et al.

[11] Patent Number: 4,491,240

[45] Date of Patent: Jan. 1, 1985

[54] COMPACT VENDING MACHINE

[76] Inventors: Frank Ruskin, 1390 Newton St., Los Angeles, Calif. 90021; Van N. Fellner, 12661 Byron Ave., Granada Hills, Calif. 91344; Joel Haynes, 18316 Oxnard St., Tarzana, Calif. 91356

[21] Appl. No.: 446,752

[22] Filed: Dec. 3, 1982

[51] Int. Cl.[3] ..... G07F 11/32

[52] U.S. Cl. ..... 221/5; 221/90

[58] Field of Search ..... 221/90, 2, 82, 86, 197, 221/287; 194/1 G, 10

[56] References Cited

U.S. PATENT DOCUMENTS 3,486,658 12/1969 Cheslak et al. ..... 221/197

*Primary Examiner*—Stanley H. Tollberg

*Attorney, Agent, or Firm*—Charmasson & Holz

[57] ABSTRACT

A vending machine which comprises a replaceable, transparent loading magazine forming an array of honeycomb slots holding the goods to be dispensed. The magazine is positioned over the slanted top of the vending machine. Each honeycomb slot has a small hinged trap door upon which the goods held therein rest. The trap door is held closed by a flexible member associated with a system of crossbars. A solenoid is used at the end of each crossbar to shift it laterally. Only the flexible member positioned at the cross point of two activated crossbars is allowed to move and release the corresponding trap door. A chute under the trap doors directs the goods falling therethrough toward a dispensing station. The goods selection is made by dialing on a keyboard the identifying symbol of the slot holding the desired item. The keyboard is activated by signals issued from a coin box after detection of the correct change. Selective enablement of certain keys according to the amount of change deposited allows for different pricing between columns of goods-holding slots.

7 Claims, 8 Drawing Figures

FIG. 4
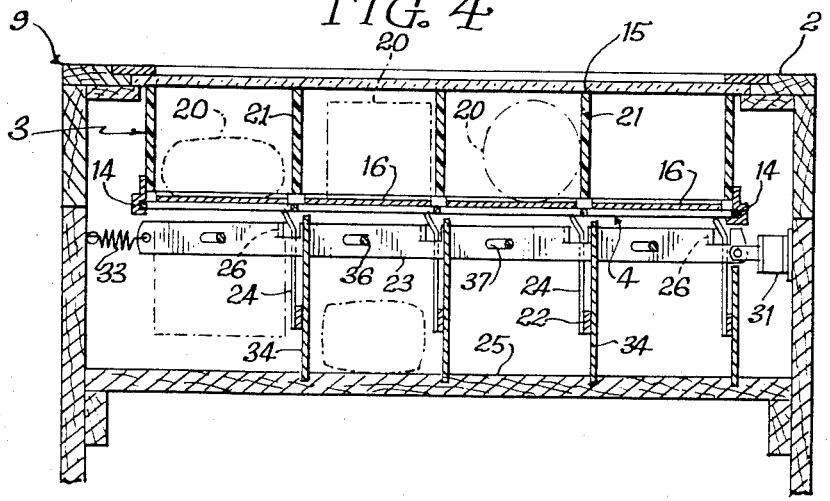
FIG. 5
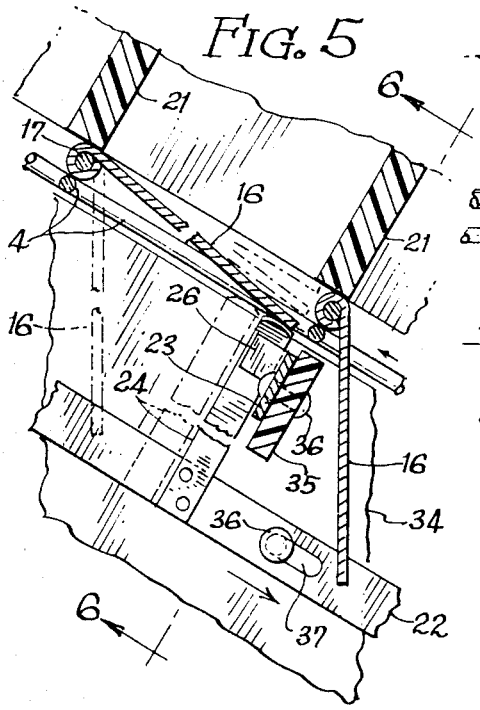
FIG. 6
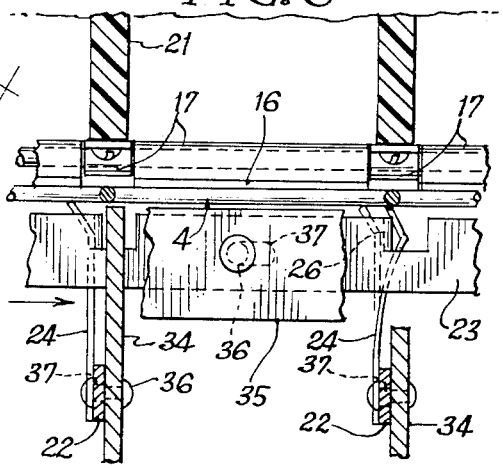
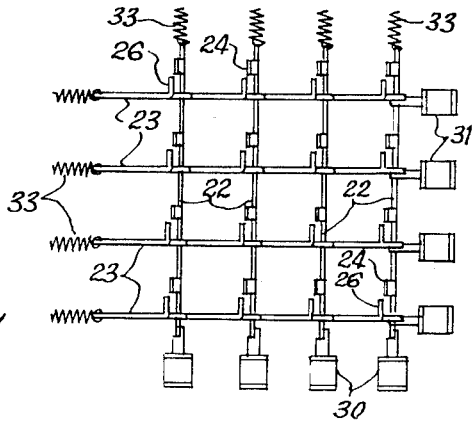
FIG. 7

COMPACT VENDING MACHINE

FIELD OF THE INVENTION

This invention relates to coin-operated vending machines and more specifically to magazine loading devices associated therewith and their release mechanism.

PRIOR ART

Coin-operated vending machines which are currently in use incorporate very complex mechanical systems. Because of the complexity and cost of these mechanical systems, it has not been previously economical nor practical to manufacture vending machines for disposing a limited number of goods. The majority of currently available coin-operated vending machines are designed to sell goods in a limited number of standard sizes such as cigarette packages or soft drink cans and bottles. This type of machine is very inefficient in the storage and handling of odd-sized items such as sandwiches or candy bags. Most coin-operated machines, in fact, are limited to the sale of specially packaged items. Furthermore, these machines cannot handle more than three or four different sizes of goods. Finally, the very complexity of their mechanical structure is the cause of many mechanical breakdowns. The prior art most closely related to the present invention is disclosed in U.S. Pat. No. 2,108,302, Barrett; U.S. Pat. No. 3,125,244, Holstein; and U.S. Pat. No. 3,802,601, Ohno.

SUMMARY OF THE INVENTION

According to the invention, a coin-operated, compact vending machine is provided which comprises a replaceable, transparent loading magazine forming an array of honeycombed slots holding the goods to be dispensed. The magazine is positioned on the slanted front face of the machine. The goods rest on a small hinged trap door provided under each slot. A chute under the trap doors directs the goods toward a dispensing station. The trap doors are electro-mechanically controlled by a system of crossbars activated by solenoids. The selection of goods is made by dialing on the keyboard the identifying symbol of the slot holding the desired item. Signals from a coin box enable the keyboard after recognition of the correct change.

It is the principal object of this invention to provide a compact vending machine capable of holding and dispensing a great variety of goods.

It is also an object of this invention to provide a vending machine in which every item to be sold can be viewed from the outside by the customer prior to his making a selection.

A further object of this invention is to provide a vending machine particularly suitable for handling odd-sized items.

Yet another object of this invention is to provide a vending machine which does not require that the goods to be sold be packaged in a standard configuration.

An additional object of this invention is to provide a machine which has a very simple mechanical structure with a minimum of moving parts.

It is also the main object of this invention to provide a vending machine in which the magazine holding the saleable items can be easily removed and replaced, whereby a set of such magazines can be pre-loaded at the distribution center, stored in a service vehicle and quickly installed as needed in the vending machine.

These and other objects are achieved in the preferred embodiment of the invention described below.

BRIEF DESCRIPTION OF THE DRAWING

FIG. 4 is a cross sectional view taken along line 4—4 of FIG. 1;

FIG. 5 is a partial, detailed cross sectional view of a trap door release mechanism;

FIG. 6 is a cross sectional view taken along line 6—6 of FIG. 5;

FIG. 7 is a top plan view of the crossbar arrangement; and

DETAILED DESCRIPTION OF THE PREFERRED EMBODIMENT OF THE INVENTION

Figure 1:
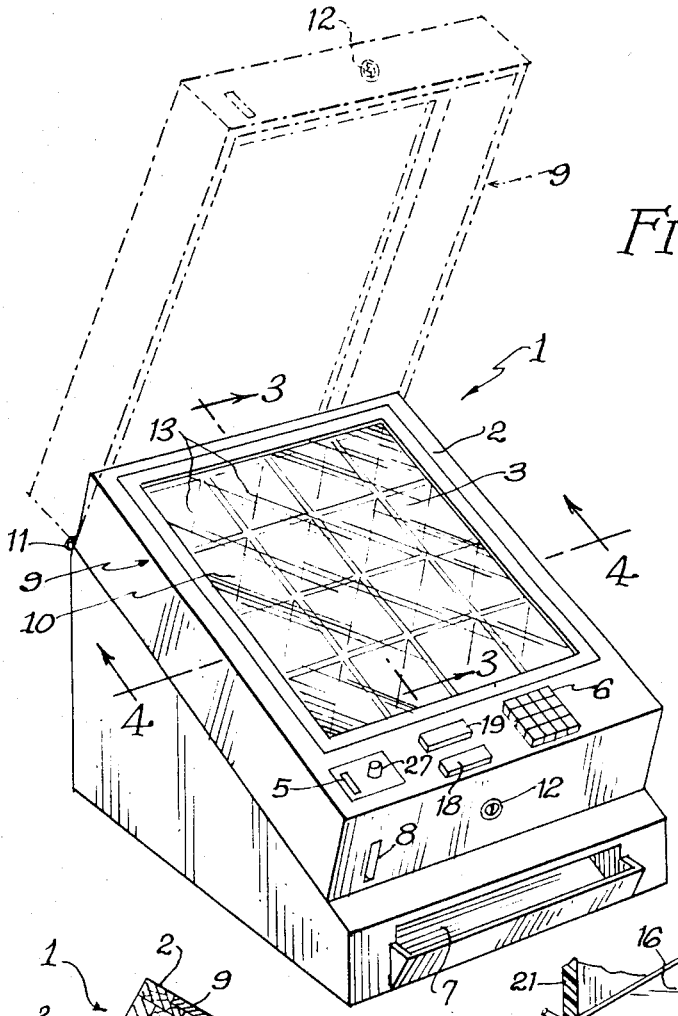
FIG. 1 is a perspective view of the preferred embodiment of the invention with the top panel in the open position.
Figure 2:
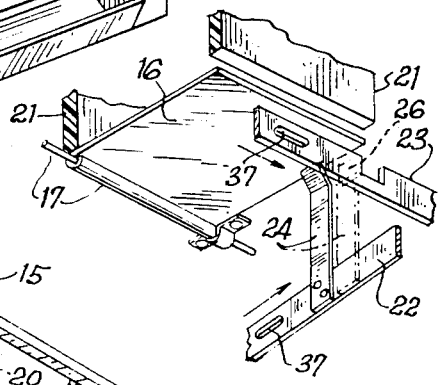
FIG. 2 is a partial perspective view of a trap door release mechanism.

Referring now to the drawing, and according to the invention, there is illustrated in FIG. 1 a coin-operated vending machine. The generally rectangular frame of the vending machine has a top 2 slanted downward, toward the position of the operator. Nested into the slanted top 2 is a loading magazine 3 characterized by a plurality of partitions 21 forming an array of rectangular slots 13. Each slot 13 of the magazine 3 is closed at the bottom by a hinged trap door 16. During transportation and storage of the magazine 3, a movable grid 4 engaged into slots 14 holds the trap door closed. The grid 4 is shifted downward once the magazine 13 is placed into the vending machine. The transversal members of the grid 4 line up with the transversal partitions 21 between the slots 13 freeing up the trap doors 16. Under the weight of the goods 20 contained in the slots 13, the trap doors 16 drop slightly until they meet flexible retaining members 24 located, respectively, near the lower right corner of each trap door. When one of the flexible retaining members 24 is shifted toward the right side, the corresponding trap door 16 is allowed to rotate around its hinge 17 and the goods 20 previously held thereupon drop into a chute 25 which directs them toward a distribution station 7. The movement of the flexible retaining member 24 is controlled by an array of crossbars 22 and 23. Each crossbar can be shifted laterally under the pull of a solenoid 30 or 31. The base of each flexible member is riveted to one of the crossbars 22. When the latter is shifted downward, the upper part of the flexible restraining member 24 comes in the path of catch tab 26 associated with one of the horizontal crossbars 23. If at this point the corresponding horizontal crossbar 23 is shifted toward the right side of the machine, the catch tab 26 deflects the flexible retaining member 24 away from the corresponding trap door 16. It can now be understood that only the trap door positioned above the cross point of two activated crossbars will be released. When the solenoids are deactivated, the corresponding crossbars are returned to their original position under the action of coil springs 32 and 33. Each vertical crossbar 22 is activated by a solenoid 30 and supported by a septum 34 raising from the floor of the chute 25. At each connection between the septum 34 and the vertical crossbar 22, a pin 36 projecting laterally from the septum engages a slot 37 in the crossbar. Similarly, each horizontal crossbar 23 is supported by a cross member 35 running parallely to the crossbar and bridging the two lateral walls of the machine.

Figure 3:
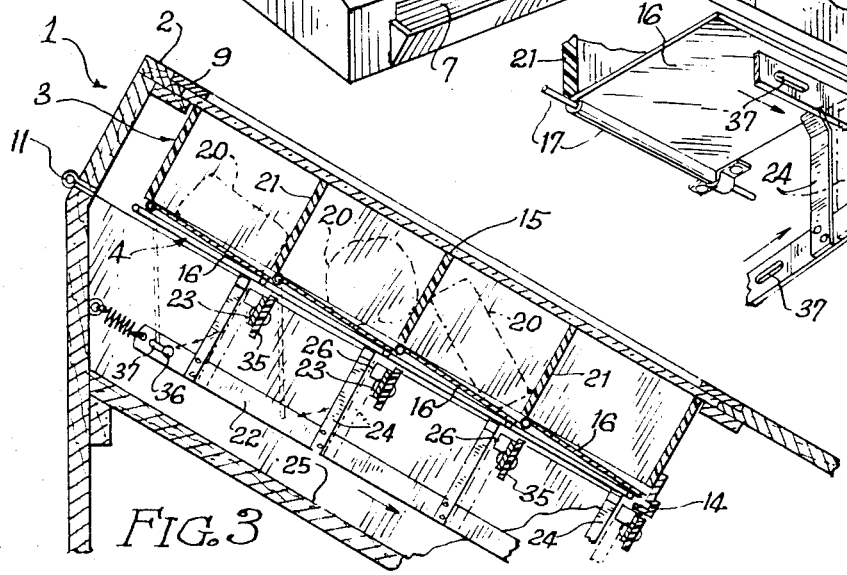
FIG. 3 is a partial cross sectional view taken along line 3—3 of FIG. 1.

One of the important features of this vending machine is that the magazine 3 can be removed and loaded with various types and sizes of goods commensurate with the size of the slots 13. As can be seen in FIGS. 3 and 4, the magazine 3 has a rim around its periphery which rests freely on a corresponding ledge in the top of the frame of the machine when the magazine is inserted. The magazine is locked in place by closing the lid 9, and can be removed and replaced or re-loaded by simply opening the lid and lifting out the magazine in any suitable manner. A plurality of loaded magazines can be kept in stock by the vending machine attendant. Although the magazine 13 described herein has been limited for the sake of convenience to sixteen slots, it should be understood that the capacity of the vending machine can be greatly expanded without unduly increasing its complexity. The electronic control system described below has been designed to accommodate an array of eight columns and fourteen rows with a total capacity for 112 slots. Once in place on the machine, the magazine 3 can be protected by closing the top door 9 and securing it by means of the keyed lock 12. The top door 9 has a transparent window 10 which allows for viewing of the goods in the various slots, and a cut out portion providing access of the various controls.

Figure 8:
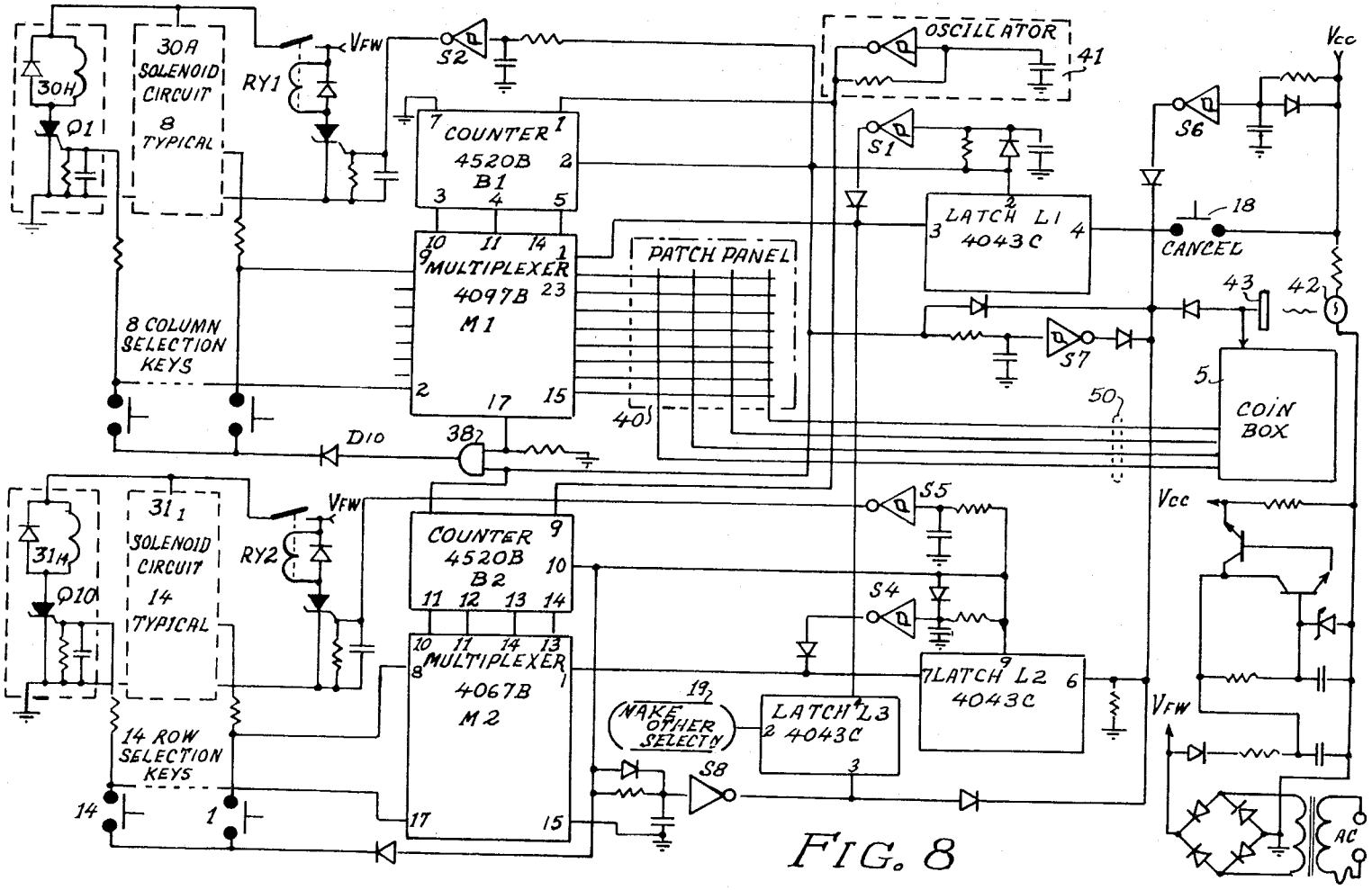
FIG. 8 is the electrical schematic of the entire apparatus.

The vending machine is operated by first inserting the required change in the slot of the coin box 5. The change can be retrieved before selection is made by pushing the coin release button 27 which releases the coin to the coin return station 8. The goods are selected by dialing on the keyboard 6 the identifying symbol engraved on the face of the corresponding slot 13. The selection requires two entries on the keyboard 6. The first entry is an alphabetical symbol corresponding to the column of the selected desired slot. The second entry is a numerical symbol identifying the corresponding row. Between the first and second entry the selection can be cancelled by pressing the cancel button 18. An indicator 19 labeled "make other selection" is lit if a selection is made of an empty slot or if the goods become jammed on their way to the distribution station 7. The detailed operation of the machine can be best understood by reference to the schematic of FIG. 8.

The coin box 5 is a solid state type device not unlike Model AL coin box manufactured by FluOnics Systems, Inc., of Tarzana, Calif.

Once the operator of the vending machine has deposited change in the coin box 5, one or more of change-indicating lines 50 raises to a logical one. These lines 50 are brought to a patch panel 40 where they can be selectively connected to eight terminal sets labeled A through H corresponding to the column identification symbols of the magazine 3. This arrangement allows for the programming of a distinct item price for each column of goods contained in the magazine 3. The column enabling signals are fed from the patch panel 40 to a multiplexer/demultiplexer chip M1, Model CD4097 manufactured by RCA. Chip M1 is controlled by a binary counter B1 constituted by half of a dual counter chip Model CD4520B manufactured by RCA. Counter B1 is in turn driven by a clock frequency issued from an oscillator 41 implemented with a Schmidt trigger which along with other Schmidt triggers in this device is part of a Model 74C14 Hex Schmidt Trigger chip manufactured by National Semiconductors. As soon as the output of counter B1 matches the first enabled column line at the input of multiplexer M1, the output line on pin 17 goes to a logical one. As long as none of the column selecting keys A through H of the keyboard 6 are pressed, counter 1 will continue to run freely. As soon as one of the column selecting keys is depressed, the output of multiplexer M1 is fed through gate 38 and diode D10 to one of its eight secondary input pins 2 through 9. Since the status of the counter B1 corresponds at that point to the depressed key, the secondary output on pin 1 of the multiplexer M1 goes to a logical one. A latch L1 constituted by one-fourth of a Model 4043C Quad R/S latch manufactured by RCA, which had been kept, until now, to the set state, is reset through pin 3. The output of the latch L1 goes to a logical zero, causing an immediate freeze of counter B1 and the closing of gate 38. The output of latch L1 is also used, after being inverted and delayed by one-half a second through Schmidt trigger S2, to energize relay RY1 through SCR Q9. Closure of the relay RY1 applies the supply voltage to the column solenoids 30. In a third path through the multiplexer M1, the output of latch L1, after being inverted and delayed by approximately one second through Schmidt trigger S1, is used to energize one of the column solenoids 30 corresponding to count status of counter B1. The selection of the column containing the desired slot is now completed. This selection can be cancelled by pressing the selection cancel button 18 which immediately sets latch L1 and returns the system to its standby mode. If the operator does not within approximately forty seconds complete a selection by depressing one of the numerical row keys, the system will be returned to the standby mode by the delayed reset circuit comprising Schmidt trigger S7.

Assuming now that the operator is about to complete his selection, it should be noted that a secondary binary counter B2 run from oscillator 41 has been unclamped through pin 15 when latch L1 was reset, and is now running freely. Counter B2 drives a second multiplexer M2 constituted by a Model CD4067 Multiplexer/-Demultiplexer chip manufactured by RCA. The multiple input/output pins 8 through 17 of multiplexer M2 are connected to the keyboard lines labeled 1 though 14 corresponding to the numerical identification of the rows of the magazine slots. In a process similar to that described in the column selection, the activation of a row key, in a first pass through multiplexer M2 causes the resetting of a second latch L2. The output of the latch, in turn, is used first to energize the coil of relay RY2 whose contact controls the supply voltage to the row solenoids 31. In a second pass through multiplexer M2, the delayed and inverted output of latch L2 is used to energize the row of solenoid 31 corresponding to the depressed key. A collimated light source 42 creates a beam directed across the lower part of the chute 25. When the goods released from one of the slots 13 of the magazine 3, while falling through the chute 25, cuts the light beam, a signal is created by a photo-diode sensor 43 which resets both latches L1 and L2 and generates an accept coin signal for the coin box. If the reset signal from the light sensor 43 is not perceived within three seconds after the row selection (indicating that the slot was empty or the goods have become jammed within the machine), a latch L3 is set by means of the delayed Schmidt trigger S8. The latch L3 drives an indicator 19 on the machine front panel requesting that another selection be made. When L1 is reset again during the next column selection, latch L3 is reset and the indicator 19 is turned off. When the power is initially turned on, the two latches L1 and L2 are set by a clear pulse generated by Schmidt trigger S6.

It should be understood that although the circuit just described can handle a crossbar array of eight columns by fourteen rows controlled by twenty-two keys from an alphanumerical keyboard, this same circuit can be used in connection with a smaller crossbar array without any circuit modification other than the illumination of unused keys.

While the preferred embodiment of the invention has been described, and modifications thereto have been suggested, other embodiments may be devised without departing from the spirit of the invention and the scope of the appended claims.

What is claimed is:

1. A goods dispensing machine which comprises:
a box-like frame;
a removable magazine positioned on top of the frame;
said magazine comprising
peripheral walls;
a plurality of vertical partitions defining an array of slots therebetween and an opening at the bottom of each of said slots;
releasible trap doors for holding a dispensible item in each of said slots above each opening; and
means for locking said trap doors when the magazine is separated from the box-like frame; said locking means comprising a structure secured against the base of said magazine and moveable relative to said base between a first position in which said trap-doors are locked and a second position in which said trap-doors are released;
said dispensing machine further comprising:
means for holding said trap-doors closed when said locking means is in said second position;
means for securing said magazine on top of said box-like frame;
a chute under said openings shaped and dimensioned to receive items falling through said openings; and
means for selectively releasing said means for holding said trap doors closed.

2. The structure claimed in claim 1 wherein said trap doors are pivotally connected to the base of said slots; and
said means for locking said trap doors comprise a planar grid secured against the base of said magazine, said grid having transverse members positioned to hold said trap doors closed in said first position and to register with said partitions in said second position to release said trap doors.

3. The structure claimed in claim 2 wherein:
said means for holding said trap doors closed comprise electromechanical latching means for holding the trap doors against said openings;
said means for releasing comprise:
a coin box designed to receive and verify change in a preselectable amount and to issue enabling signals;
a keyboard enabled by said signals for selecting any one of said slots; and
electric circuit means responsive to said keyboard selection for activating the electromechanical latching means corresponding to the selected slot.

4. The structure claimed in claim 3 wherein said electromechanical latching means comprise:
a crossbar array;
a solenoid linked to each crossbar for applying a longitudinal shift to said crossbar;
at each cross point, a movable member for holding one of the trap doors in the closed position; and
means on said crossbar for deflecting said movable member away from said trap door at the cross point of two activated crossbars.

5. The structure claimed in claim 4 wherein said electrical circuit comprises:
means for selectively energizing said solenoids in response to information dialed on said keyboard.

6. The structure claimed in claim 5 wherein said means for energizing comprise:
a first means for selectively enabling keyboard keys in response to money amount indicating signals from the coin box; and
means for controlling one of said solenoids by depressing one of said enabled keys.

7. The structure claimed in claim 2 wherein said magazine has a transparent top allowing the external viewing of the dispensible items within said slots.

* * * * *